US007074012B2

(12) United States Patent
Nishimura et al.

(10) Patent No.: US 7,074,012 B2
(45) Date of Patent: Jul. 11, 2006

(54) TURBINE BLADE

(75) Inventors: Keiji Nishimura, Sayama (JP); Takahiro Ogi, Tokorozawa (JP); Hideyuki Nishi, Tokorozawa (JP); Toshiyuki Matsumoto, Setagaya-ku (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 58 days.

(21) Appl. No.: 10/743,091

(22) Filed: Dec. 23, 2003

(65) Prior Publication Data

US 2004/0247442 A1 Dec. 9, 2004

(30) Foreign Application Priority Data

Jun. 4, 2003 (JP) ..... 2003-159175

(51) Int. Cl.
*F01D 5/14* (2006.01)

(52) U.S. Cl. ..... 416/193 A; 416/248; 451/28

(58) Field of Classification Search ..... 416/193 A, 416/248, 219 R, 220 R, 500, 190; 451/28
See application file for complete search history.

(56) References Cited

U.S. PATENT DOCUMENTS

| | | | | |
|---|---|---|---|---|
| 4,638,602 | A * | 1/1987 | Cavalieri | 451/365 |
| 4,872,812 | A * | 10/1989 | Hendley et al. | 416/190 |
| 5,924,699 | A * | 7/1999 | Airey et al. | 416/193 A |
| 6,017,263 | A | 1/2000 | Dwyer | |
| 6,068,541 | A * | 5/2000 | Dwyer | 451/28 |
| 6,354,803 | B1 * | 3/2002 | Grover et al. | 416/193 A |
| 6,786,696 | B1 * | 9/2004 | Herman et al. | 416/193 A |
| 6,842,995 | B1 * | 1/2005 | Jones et al. | 33/645 |
| 6,855,033 | B1 * | 2/2005 | Jones et al. | 451/28 |
| 6,857,853 | B1 * | 2/2005 | Tomberg et al. | 416/248 |

FOREIGN PATENT DOCUMENTS

JP 10-196309 7/1998

* cited by examiner

*Primary Examiner*—Christopher Verdier

(57) ABSTRACT

A front engagement face 27*f* of a front engagement member 27 and a rear engagement face 29*f* of a rear engagement member 29 are respectively configured to be located a little back from a virtual plane VF coplanar with one side of a platform 15 and also to be substantially parallel to the axial direction of a male dovetail 25, and an end face of a front wall Wf integrally molded in the vicinity of a base portion of a front seal fin 21 and an end face of a rear wall Wr integrally molded in the vicinity of a base portion of a rear seal fin 23 are respectively configured to be coplanar with the virtual plane Vf.

9 Claims, 5 Drawing Sheets

TURBINE BLADE

CROSS REFERENCE TO RELATED APPLICATION

This application claims benefit of priority under 35USC § 119 to Japanese Patent Application No. 2003-159175, filed on Jun. 4, 2003, the entire contents of which are incorporated by reference herein.

BACKGROUND OF THE INVENTION

1. Field of the Invention

The present invention relates to a turbine blade to be installed into a female dovetail of a turbine disk of an aircraft engine.

2. Description of the Related Art

The constitution of a typical turbine blade to be installed into a female dovetail of a turbine disk of an aircraft will be described below.

A typical turbine blade includes a blade airfoil as a blade base, one side of the blade airfoil being a convex suction surface and the other side of the blade being a concave pressure surface. A platform is integrally molded on the hub side (at the base end portion) of the blade and recesses are formed respectively on both sides of the platform. A front seal fin protruding forward is formed at the front end of the platform and a rear seal fin protruding backward is formed at the back end of the platform.

A male dovetail is integrally disposed on the hub side (at the base end portion) of the platform, the dovetail has an engagement portion able to engage with a female dovetail of a turbine disk, and the engagement portion is usually formed by grinding, whereby, a jig is used for grinding, and one side of the platform can be engaged against a platform-locating portion of the jig.

The manufacturing process of the typical turbine blade will be described below. The greater part of the turbine blade with the engagement portion remaining unfinished (an unfinished turbine blade) is molded by casting. Next, the unfinished turbine blade is located in the jig so as to make the dovetail axial direction perpendicular to the repulsive force due to work-resistance during grinding, by letting the pressure surface of the blade airfoil be supported with a support portion of the jig. Further, setting of the unfinished turbine blade onto the jig is completed by pressing the pressure surface of the blade airfoil against the location portion by means of a clamp of the jig. Then, the turbine blade is finished by forming the engagement portion along the dovetail axial direction by grinding.

SUMMARY OF THE INVENTION

In order for the blade airfoil to be disposed obliquely against the engine axial direction of the aircraft engine, both sides of the platform are angled to the dovetail axial direction of the engagement portion. Consequently, during formation of the engagement portion along the dovetail axial direction by grinding, a component of a force that may cause a displacement of the blade airfoil from the jig is generated. Therefore, there is a problem in that a machining tolerance of the engagement portion is degraded, lowering the quality of the turbine blade, because the unfinished turbine blade is displaced from the jig owing to an increase in the magnitude of the component of a force during grinding.

According to the present invention the unfinished turbine blade is never displaced from the jig, forming an engagement portion with tight machining tolerance, thus enhancing the quality of the turbine blade.

According to a first technical aspect of the present invention, a turbine blade to be installed into an engaged member of a turbine disk of an aircraft engine is characterized in that it comprises a blade airfoil, one side of which having a convex suction surface and the other side having a concave pressure surface; a platform integrally molded on the hub side of the blade wherein a recess is formed on one side of the platform; a front seal fin formed protruding forward at the front end of the platform; and a rear seal fin formed protruding backward at the back end of the platform, an engagement member integrally molded on the hub side of the platform wherein the engagement member has a engagement face which is able to be engaged with the engaged member of turbine disk and is formed by grinding, a front engagement member integrally molded in the vicinity of a base portion of the front seal fin wherein the front engagement member has a front engagement face able to engage with a front locating portion of a jig to be used for the grinding, and the front engagement face located back from a virtual plane including one side of the platform, a front wall integrally molded in the vicinity of the base portion of the front seal fin wherein the front wall surrounds a front side-edge portion of the front engagement member, a rear engagement member integrally molded in the vicinity of a base portion of the rear seal fin wherein the rear engagement member has a rear engagement face able to engage with a rear locating portion of the jig, and the rear engagement face located back from the virtual plane, and a rear wall integrally molded in the vicinity of the base portion of the rear seal fin, where the rear wall surrounds a rear side-edge portion of the rear engagement member, wherein an end face of the front wall and an end face of the rear wall are respectively configured to be coplanar with the virtual plane.

According to a second technical aspect of the present invention, the turbine blade is characterized in that the front engagement face and the rear engagement face are respectively configured to be substantially parallel to the longitudinal direction of the engagement member.

According to a third technical aspect of the present invention, the turbine blade is further characterized in that the spacing between the front edge of the front engagement face and the rear edge of the rear engagement face are configured to be longer than the longitudinal length of the engagement member.

According to a fourth technical aspect of the present invention, the turbine blade is further characterized in that the depth that the front engagement face is located back from the virtual plane and the depth that the rear engagement face is located back from the virtual plane are respectively configured to be in a range of less than or equal to 0.7 mm.

DESCRIPTION OF THE PREFERRED EMBODIMENT

Figure 1:
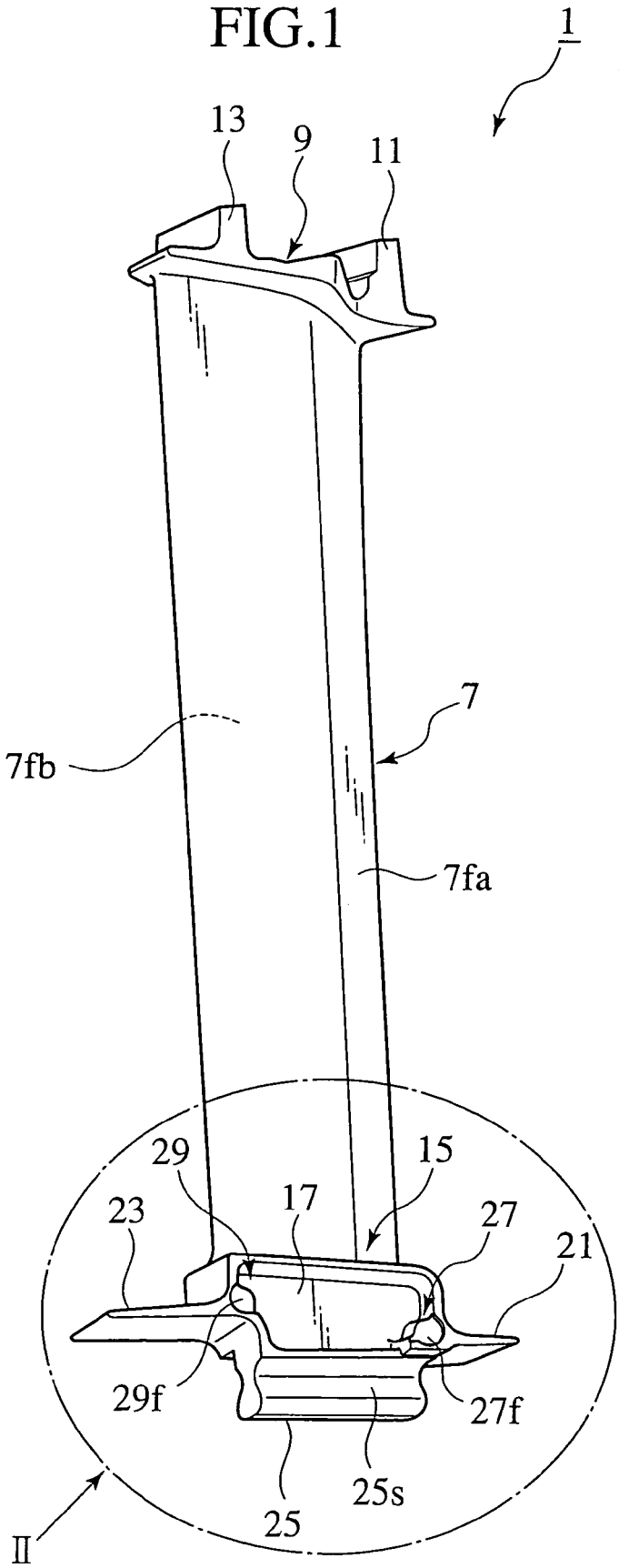
FIG. 1 shows a turbine blade according to an embodiment of the present invention.
Figure 2:
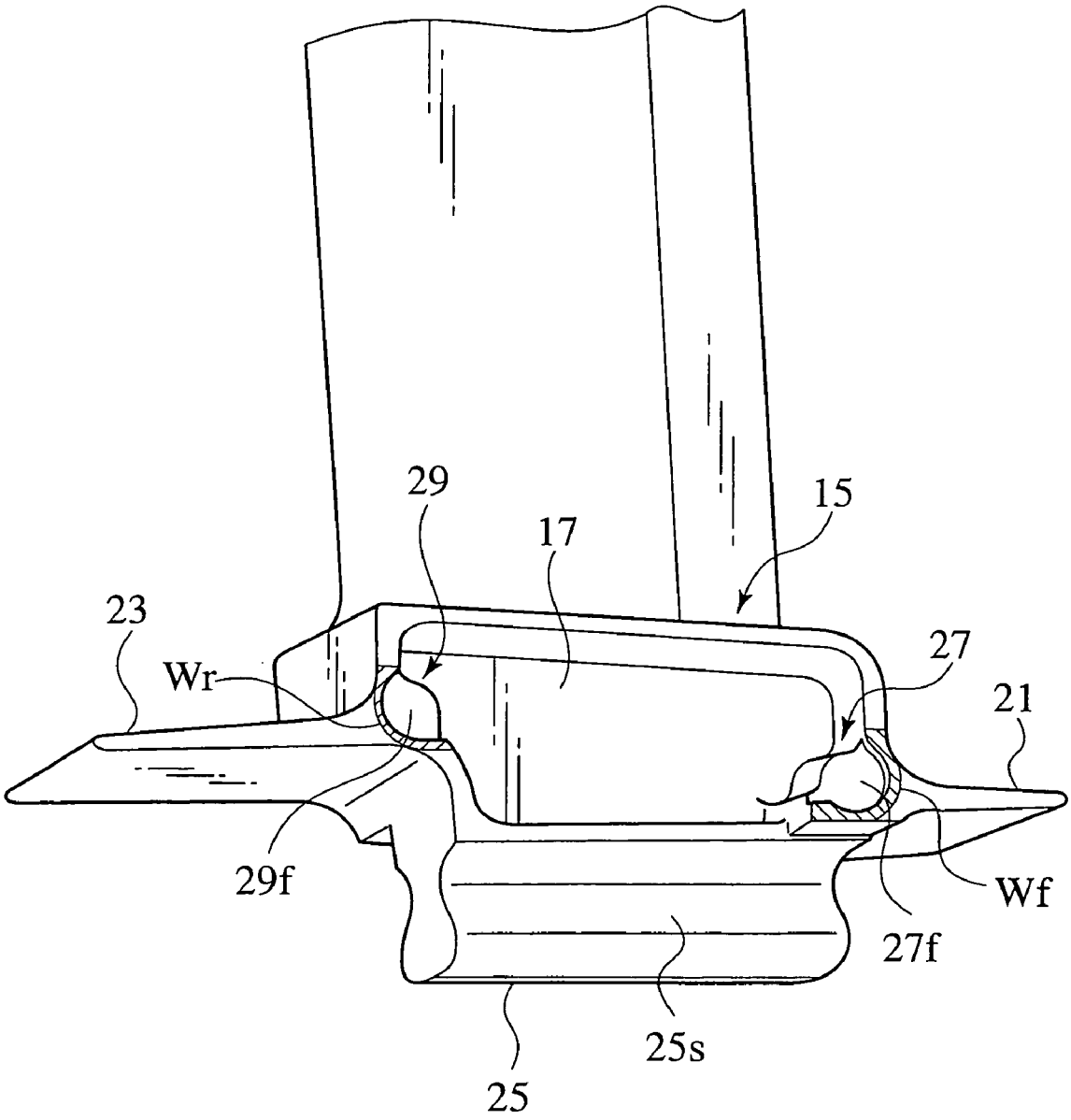
FIG. 2 is an enlarged view of the arrowed portion II in FIG. 1.
Figure 3:
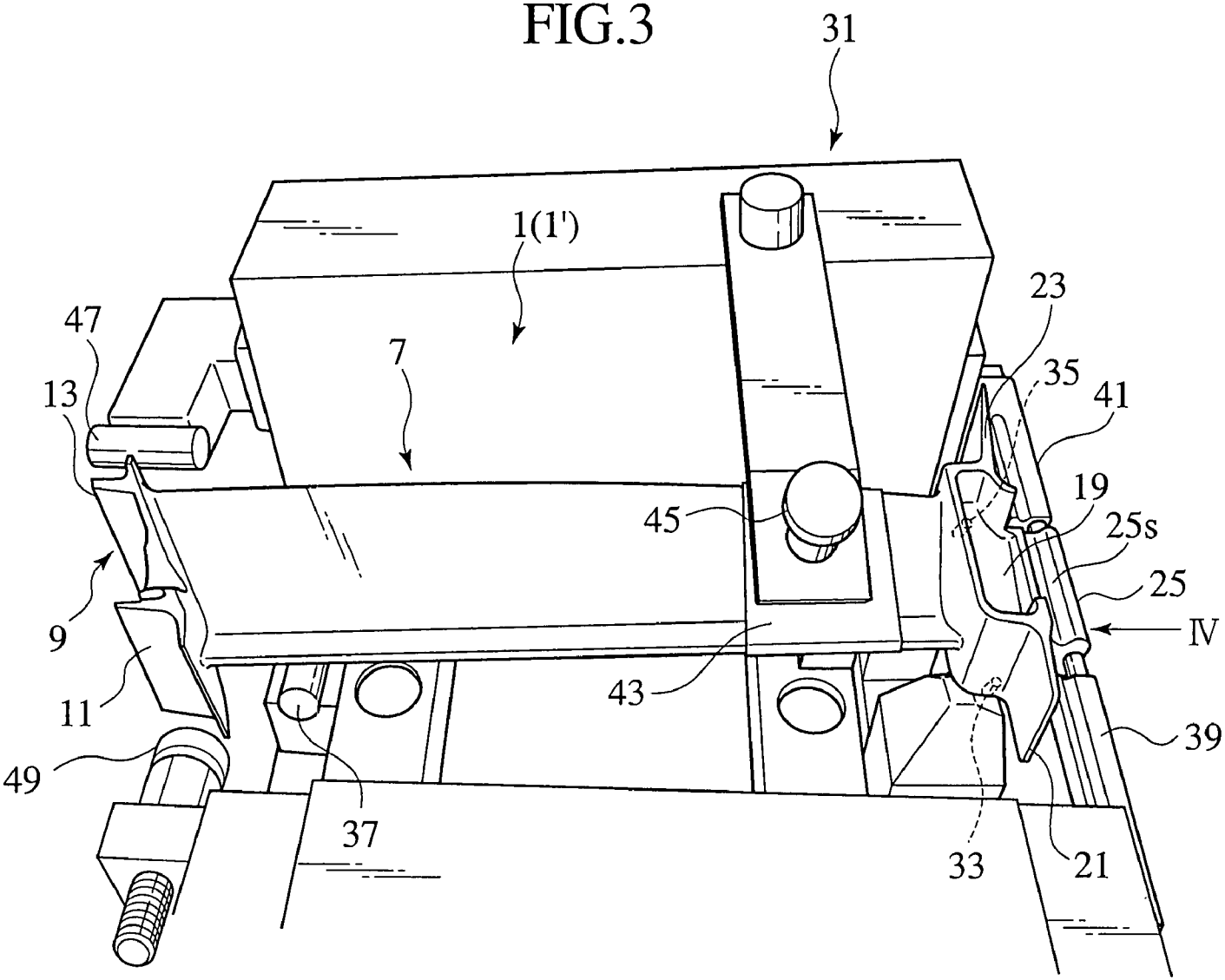
FIG. 3 shows a state where the turbine blade according to the embodiment of the present invention is set on a jig.
Figure 4:
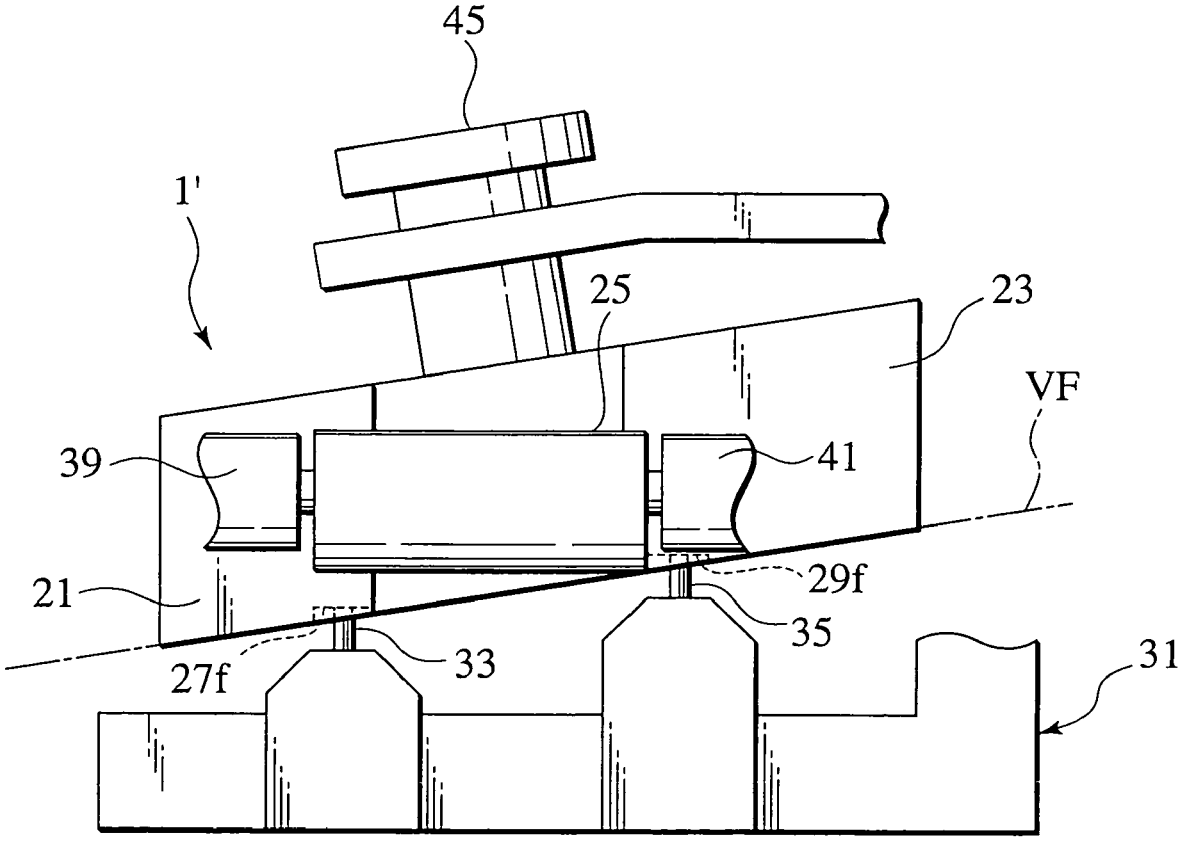
FIG. 4 is a schematic view of the arrowed portion IV in FIG. 3.
Figure 5:
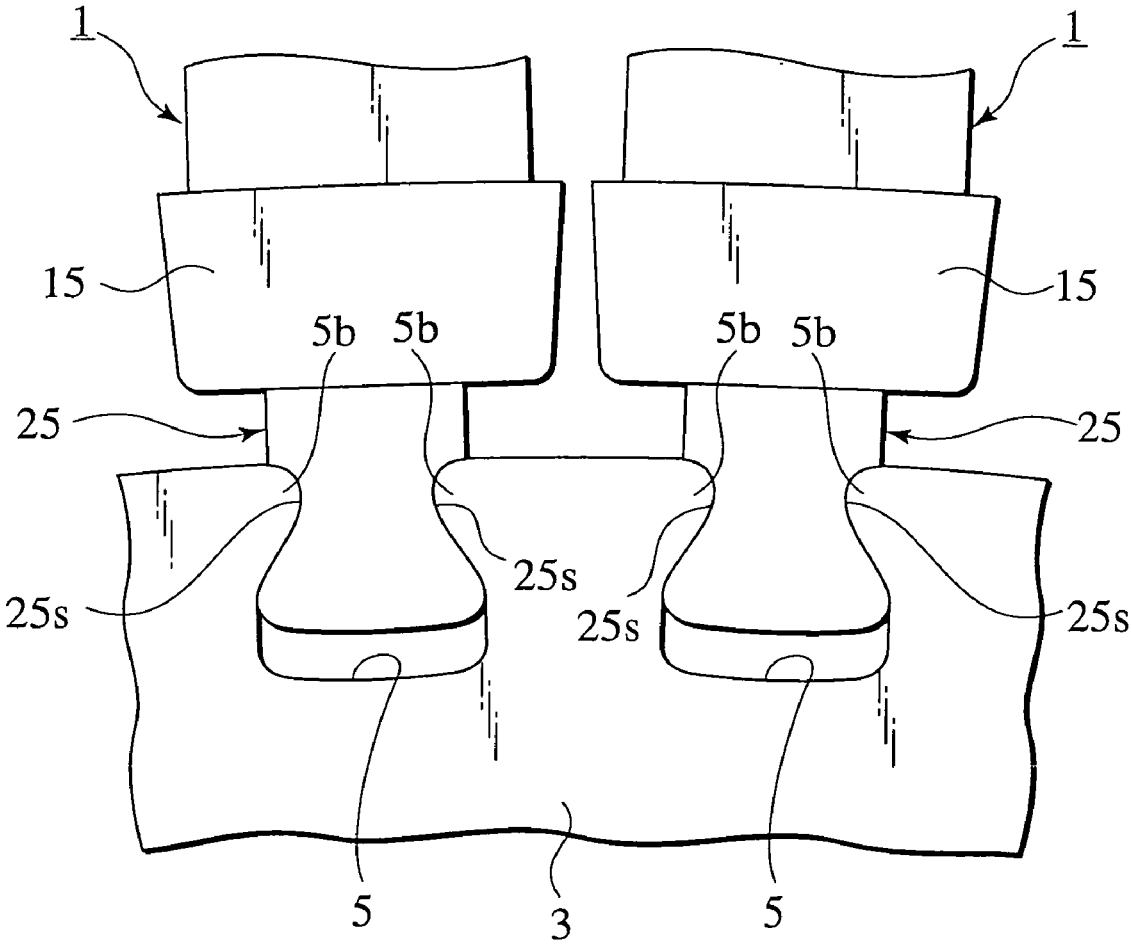
FIG. 5 shows a state where the turbine blade according to the embodiment of the present invention is installed into a female dovetail of a turbine disk.

An embodiment of the present invention will be described below referring to FIG. 1 to FIG. 5. FIG. 1 shows a turbine blade according to an embodiment of the present invention; FIG. 2 is an enlarged view of the arrowed portion II in FIG. 1; FIG. 3 shows a state where the turbine blade according to the embodiment of the present invention is set on a jig; FIG. 4 is a schematic view of the arrowed portion IV in FIG. 3; and FIG. 5 shows a state where the turbine blade according to the embodiment of the present invention is installed into a female dovetail of a turbine disk. Herein, "front and rear (or back)" refers to the right hand side and left hand side in FIG. 1 and FIG. 2, and refers to the left hand side and right hand side in FIG. 4.

As shown in FIGS. 1, 2 and 5, the turbine blade 1 relating to the embodiment of the present invention is one to be installed into a female dovetail 5 of a turbine disk 3 of a low-pressure turbine for an aircraft engine and comprises a blade airfoil 7 as a main body of the turbine blade 1. One side (the front side in FIG. 1) of the blade airfoil 7 is a convex suction surface 7*fa* and the other side (the back side in FIG. 1) of the blade airfoil 7 is a concave pressure surface 7*fb*.

A shroud 9 is integrally molded on the tip side (the outer end portion, the upside in FIG. 1) of the blade airfoil 7 and the shroud 9 has a couple of seal fins 11, 13.

A platform 15 is integrally molded on the hub side (the inner end portion, the downside in FIG. 1) of the blade airfoil 7, and recesses 17, 19 each having a face are formed respectively on both sides (the one side and the other side) the platform 15. Moreover, a front seal fin 21 protruding forward is formed at the front end of the platform, and a rear seal fin 23 protruding backward is formed at the back end of the platform 15. A so-called shank portion is also included in the platform.

Further, a male dovetail 25 as an engagement member is integrally molded on the hub side of the platform 15 and the male dovetail 25 has an engagement groove (an engagement face) 25*s* which is able to be engaged with an engaged protrusion (an engaged portion) 5*b* of the female dovetail 5 as an engaged member, and the engagement groove 25*s* is formed by grinding.

A front engagement member 27 is integrally molded within the recess 17 in the vicinity of a base portion of the front seal fin 21 and the front engagement member 27 has a planar front engagement face 27*f*. Further, as shown with diagonal lines in FIG. 2, a thin front semi-circular shaped wall Wf surrounding a front side-edge portion of the front engagement member 27 is integrally molded in the vicinity of the base portion of the front seal fin 21.

Moreover, a rear engagement member 29 is integrally molded within the recess 17 in the vicinity of a base portion of the rear seal fin 23 and the rear engagement member 29 has a planar rear engagement face 29*f*. Further, as shown with diagonal lines in FIG. 2, a thin rear wall semi-circular shaped Wr, which surrounds a rear side-edge portion of the rear engagement member 29, is integrally molded in the vicinity of the base portion of the rear seal fin 23.

As shown in FIG. 3 and FIG. 4, the front engagement face 27*f* of the front engagement member 27 is able to be engaged by a front locator pin 33 of a jig 31 to be used for the grinding, and the rear engagement face 29*f* of the rear engagement member 29 is able to be engaged against a rear locator pin 35 of the jig 31. Moreover, the front engagement face 27*f* of the front engagement member 27 and the rear engagement face 29*f* of the rear engagement member 29 are respectively configured to be located slightly back from a virtual plane VF including one side of the platform 15 and also to be substantially parallel to the dovetail axial direction (longitudinal direction) of the male dovetail 25.

The front engagement face 27*f* is offset forward from the face of the recess toward the virtual plane VF. The front engagement face 27*f* is located in a first plane positioned back from the virtual plane VF. The rear engagement face 29*f* is located in a second plane, different from the first plane, back from the virtual plane VF and offset forward from the face of the recess toward the virtual plane VF. Particularly, the distance (depth) of which the front engagement face 27*f* is located back from the virtual plane VF and the distance (depth) of which the rear engagement face 29*f* is located back from the virtual plane VF are respectively configured to be in a range of less than or equal to 0.7 mm. In other words, each of the front engagement face 27*f* of the front engagement member 27 and the rear engagement face 29*f* of the rear engagement member 29 has a recess in a range of less than or equal to 0.7 mm. Further, the spacing between the front edge of the front engagement face 27*f* and the rear edge of the rear engagement face 29*f* are configured to be longer than the length of the male dovetail 25 in the dovetail axial direction.

An end face of the front wall Wf and an end face of the rear wall Wr are respectively configured to be coplanar with the virtual plane VF.

The jig 31 includes the front locator pin 33 and a rear locator pin 35 as well as a locating roller 37 for locating the suction surface 7*fa* near the tip of the blade airfoil 7, a locating pin 41 for clipping the male dovetail 25 at the rear side thereof and a clip 39 for clipping the male dovetail 25 at the front side thereof, and a clamp 45 for pressing the pressure surface 7*fb* near the hub of the blade airfoil 7 downward via a rubber pad 43, an engagement roller 47 able to be engaged against the back end of the shroud 9, a contact bolt 49 able to be contacted with the front end of the shroud 9.

The operation (mainly manufacturing of the turbine blade 1) of an embodiment of the present invention will be described below. The greater part of the turbine blade 1, with machining portions of the engagement groove 25*s* and the shroud 9 remaining unfinished (an unfinished turbine blade 1'), is molded by casting. Since the vicinity of base portion of the front seal fin 21 is configured to be thicker in consideration of the strength of the fin, the front engagement member 27 and the front wall Wf are molded utilizing the thicker portion. Also, since the vicinity of base portion of the rear seal fin 23 is configured to be thicker in consideration of the strength of the fin, the rear engagement member 29 and the rear wall Wr are molded utilizing the thicker portion.

Since each of the front engagement face 27*f* and the rear engagement face 29*f* has a recess in a range of less than or equal to 0.7 mm, casting defects do not easily occur in the vicinity of the front engagement face 27*f* and the rear engagement face 29*f*. After molding the greater part of the turbine blade 1, the machining portion of the shroud 9 is operated by appropriate machining.

Next, the front engagement face 27*f* of the front engagement member 27 and the rear engagement face 29*f* of the rear engagement member 29 are engaged by the front locator pin 33 of the jig 31 and the rear locator pin 35 of the jig 31 respectively, and the suction surface 7*fa* of the blade airfoil 7 is made to be located with the locating roller 37 of the jig 31. Thereby, the unfinished turbine blade 1' can be located in the jig 31 so as to make the dovetail axial direction perpendicular to the repulsive force due to work-resistance during grinding. Besides, location of the unfinished turbine blade 1' relative to the jig 31 in the machining direction is also performed by engaging the back end of the shroud 9 with the engagement roller 47 of the jig 31 to make the contact bolt 49 contact with the front end of the shroud 9.

Further, the male dovetail 25 is located at the rear end of the dovetail 25 with a locating pin 41 of the jig 31, and clipped with a clip 39 at the front end of the dovetail 25, and the pressure surface 7*fb* near the hub of the blade airfoil 7 is pressed downward with a clamp 45 of the jig 31 via a rubber pad 43. Thereby, the setting of the unfinished turbine blade 1' onto the jig 31 is completed. Since the spacing between the front edge of the front engagement face 27*f* and the rear edge of the rear engagement face 29*f* has been configured to be longer than the longitudinal length of the engagement member, the loaded state of the unfinished turbine blade 1' on the jig 31 is further stabilized.

Then, the manufacturing of the turbine blade 1 is finished by forming the engagement groove 25*s* along the dovetail axial direction by the grinding. Since the front engagement face 27*f* of the front engagement member 27 and the rear engagement face 29*f* of the rear engagement member 29 are respectively configured to be substantially parallel to the dovetail axial direction, only the repulsive force, which is due to work resistance and is perpendicular to the dovetail axial direction, will occur on the front engagement face 27*f* and the rear engagement face 29*f* in a case where the engagement groove 25*s* is formed along the dovetail axial direction by grinding. Therefore, substantially no repulsive force, which displaces the longitudinal direction of the dovetail, will occur.

In addition to the operation described above, the front engagement face 27*f* of the front engagement member 27 and the rear engagement face 29*f* of the rear engagement member 29 are respectively configured to be located slightly back from the virtual plane VF including one side of the platform 15. And also, the end face of the front wall Wf and the end face of the rear wall Wr are respectively configured to be coplanar with the virtual plane VF. Therefore, the spacing between adjacent turbine blades 1 will not be widened locally when a number of turbine blades 1 are installed into the turbine disk 3.

According to the embodiment of the present invention, since only the repulsive force being perpendicular to the dovetail axial direction will occur on the front engagement face 27*f* and the rear engagement face 29*f* in a case where the engagement groove 25*s* is formed along the dovetail axial direction by grinding, enhancement in quality of the turbine blade 1 can be achieved because the unfinished turbine blade 1' will not be displaced from the jig 31 during grinding, thus preventing degradation of the machining tolerance of the engagement groove 25*s*. Particularly, since the set state of the unfinished turbine blade 1' is further stabilized, a further improvement in quality of the turbine blade 1 can be achieved by enhancing the machining tolerance of the engagement groove 25*s*.

According to the embodiment of the present invention, the front engagement member 27 and the front wall Wf are molded utilizing the thicker portion which is configured to be thicker in consideration to the strength of the front seal fin 21, and the rear engagement member 29 and the rear wall Wr are molded utilizing the thicker portion which is configured to be thicker in consideration to the strength of the rear seal fin 23. Therefore, the addition of the front engagement member 27, the front wall Wf, the rear engagement member 29 and the rear wall Wr to the components of the turbine blade 1 does not cause any increase in a weight of the turbine blade 1.

Further, since casting defects can do not easily occur in the vicinity of the front engagement face 27*f* and in the vicinity of the rear engagement face 29*f*, the occurrence of rejects of the turbine blade 1 can be reduced.

Moreover, since the spacing between adjacent turbine blades 1 is not be extended locally when a number of turbine blades 1 are installed into the turbine disk 3, a flow of high-temperature gas from the main stream toward the center of the engine can be prevented during the operation of the aircraft engine to increase the engine efficiency of the aircraft engine and to avoid temperature increase of the turbine disk 3.

Further, the present invention should not be limited to the description of the above embodiment of the invention, but it can be applicable in various modes through causing the appropriate conversion thereof, for example, an application of the turbine blade 1 to a turbine blade for a high-pressure turbine of the aircraft engine, etc.

Modifications and variations of the embodiments described above will occur to those skilled in the art, in light of the teachings. The scope of the invention is defined with reference to the following claims.

What is claimed is:

1. A turbine blade to be installed into an engaged member of a turbine disk of an aircraft engine comprising:

one side of the blade having a convex suction surface and the other side of the blade having a concave pressure surface;

a platform integrally molded on a hub side of the blade, a recess with a face and formed on one side of the platform, a front seal fin formed protruding forward at the front end of the platform, and a rear seal fin formed protruding backward at the back end of the platform;

an engagement member integrally molded on the hub side of the platform, the engagement member having an engagement face which is able to be engaged with the engaged member and is formed by grinding;

a front engagement member integrally molded in the vicinity of a base portion of the front seal fin, the front engagement member having a planar front engagement face able to engage with a front locating portion of a jig to be used for the grinding, and the front engagement face located in a first plane positioned back from a virtual plane including the one side of the platform and offset forward from the face of the recess toward the virtual plane;

a front wall integrally molded in the vicinity of the base portion of the front seal fin, the front wall surrounding a front side-edge portion of the front engagement member to form a semi-circular shape;

a rear engagement member integrally molded in the vicinity of a base portion of the rear seal fin, the rear engagement member having a planar rear engagement face able to engage with a rear locating portion of the jig, and the rear engagement face located in a second plane, different from the first plane, back from the virtual plane and offset forward from the face of the recess toward the virtual plane; and a rear wall integrally molded in the vicinity of the base portion of the rear seal fin, the rear wall surrounding a rear side-edge portion of the rear engagement member to form a semi-circular shape, wherein an end face of the front wall and an end face of the rear wall are respectively configured to be coplanar with the virtual plane.

2. The turbine blade of claim 1, wherein the front engagement face and the rear engagement face are respectively configured to be substantially parallel to the longitudinal direction of the engagement member.

3. The turbine blade of claim 2, wherein each of the front engagement face and the rear engagement face is part of a recess with a depth in a range of less than or equal to 0.7 mm.

4. The turbine blade of claim 1, wherein each of the front engagement face and the rear engagement face is part of a recess with a depth in a range of less than or equal to 0.7 mm.

5. The turbine blade of claim 1, wherein the engaged member is a female dovetail and the engagement member is a male dovetail.

6. A turbine blade to be installed into an engaged member of a turbine disk of an aircraft engine comprising:

one side of the blade having a convex suction surface and the other side of the blade having a concave pressure surface;

a platform integrally molded on a hub side of the blade, a recess being formed on one side of the platform, a front seal fin formed protruding forward at the front end of the platform, and a rear seal fin formed protruding backward at the back end of the platform;

an engagement member integrally molded on the hub side of the platform, the engagement member having an engagement face which is able to be engaged with the engaged member and is formed by grinding;

a front engagement member integrally molded in the vicinity of a base portion of the front seal fin, the front engagement member having a front engagement face able to engage with a front locating portion of a jig to be used for the grinding, and the front engagement face located back from a virtual plane including the one side of the platform;

a front wall integrally molded in the vicinity of the base portion of the front seal fin, the front wall surrounding a front side-edge portion of the front engagement member;

a rear engagement member integrally molded in the vicinity of a base portion of the rear seal fin, the rear engagement member having a rear engagement face able to engage with a rear locating portion of the jig, and the rear engagement face located back from the virtual plane; and a rear wall integrally molded in the vicinity of the base portion of the rear seal fin, the rear wall surrounding a rear side-edge portion of the rear engagement member, wherein an end face of the front wall and an end face of the rear wall are respectively configured to be coplanar with the virtual plane, and wherein the spacing between the front edge of the front engagement face and the rear edge of the rear engagement face is configured to be longer than the longitudinal length of the engagement member.

7. The turbine blade of claim 6, wherein each of the front engagement face and the rear engagement face is part of a recess with a depth in a range of less than or equal to 0.7 mm.

8. A turbine blade to be installed into an engaged member of a turbine disk of an aircraft engine comprising:

one side of the blade having a convex suction surface and the other side of the blade having a concave pressure surface;

a platform integrally molded on a hub side of the blade, a recess being formed on one side of the platform, a front seal fin formed protruding forward at the front end of the platform, and a rear seal fin formed protruding backward at the back end of the platform;

an engagement member integrally molded on the hub side of the platform, the engagement member having an engagement face which is able to be engaged with the engaged member and is formed by grinding;

a front engagement member integrally molded in the vicinity of a base portion of the front seal fin, the front engagement member having a front engagement face able to engage with a front locating portion of a jig to be used for the grinding, and the front engagement face located back from a virtual plane including the one side of the platform;

a front wall integrally molded in the vicinity of the base portion of the front seal fin, the front wall surrounding a front side-edge portion of the front engagement member;

a rear engagement member integrally molded in the vicinity of a base portion of the rear seal fin, the rear engagement member having a rear engagement face able to engage with a rear locating portion of the jig, and the rear engagement face located back from the virtual plane; and a rear wall integrally molded in the vicinity of the base portion of the rear seal fin, the rear wall surrounding a rear side-edge portion of the rear engagement member, wherein an end face of the front wall and an end face of the rear wall are respectively configured to be coplanar with the virtual plane, wherein the front engagement face and the rear engagement face are respectively configured to be substantially parallel to the longitudinal direction of the engagement member, and wherein the spacing between the front edge of the front engagement face and the rear edge of the rear engagement face is configured to be longer than the longitudinal length of the engagement member.

9. The turbine blade of claim 8, wherein each of the front engagement face and the rear engagement face is part of a recess with a depth in a range of less than or equal to 0.7 mm.

* * * * *